US010000999B2

(12) United States Patent
Diehl

(10) Patent No.: US 10,000,999 B2
(45) **Date of Patent: *Jun. 19, 2018**

(54) APPARATUS FOR THE INDUCTIVE HEATING OF OIL SAND AND HEAVY OIL DEPOSITS BY WAY OF CURRENT-CARRYING CONDUCTORS

(71) Applicant: SIEMENS AKTIENGESELLSCHAFT, München (DE)

(72) Inventor: Dirk Diehl, Bubenreuth (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 921 days.

This patent is subject to a terminal disclaimer.

(21) Appl. No.: 14/285,767

(22) Filed: May 23, 2014

(65) Prior Publication Data

US 2014/0326444 A1 Nov. 6, 2014

Related U.S. Application Data

(63) Continuation of application No. 12/920,869, filed as application No. PCT/EP2009/052183 on Feb. 25, 2009, now Pat. No. 8,766,146.

(30) Foreign Application Priority Data

Mar. 6, 2008 (DE) ..... 10 2008 012 855
Dec. 15, 2008 (DE) ..... 10 2008 062 326

(51) Int. Cl.

| | |
|---|---|
| ***E21B 43/24*** | (2006.01) |
| ***E21B 36/04*** | (2006.01) |
| ***H05B 6/10*** | (2006.01) |

(52) U.S. Cl.
CPC ..... *E21B 43/2401* (2013.01); *E21B 36/04* (2013.01); *H05B 6/105* (2013.01); *H05B 6/108* (2013.01); *H05B 2214/03* (2013.01)

(58) Field of Classification Search
CPC ... E21B 43/2401; H05B 2214/03; H05B 6/50; H05B 6/62

(Continued)

(56) References Cited

U.S. PATENT DOCUMENTS 2,678,368 A * 5/1954 Williamson ..... B23K 13/02 219/612
4,980,517 A * 12/1990 Cardas ..... H01B 7/0009 174/129 R (Continued)

FOREIGN PATENT DOCUMENTS

DE 10 2004 009 896 A1 9/2005
DE 10 2007 008 292 A1 8/2008

(Continued)

OTHER PUBLICATIONS

A. Sahni et al., "Electromagnetic Heating Methods for Heavy Oil Reservoirs", SPE 62550, May 2000, p. 1-10.
Bruce C.W. McGee, "Electrical Heating with Horizontal Wells, the Heat Transfer Problem," Proceedings SPE37117, Calgary, Nov. 1996, p. 685-697.
S.T.Fisher, "Induction Heating in Situ of the Solid Fossil Fuels", Energy Engineering, vol. 81, Jan. 1, 1984, p. 11-23.

*Primary Examiner* — Dana Ross
*Assistant Examiner* — Joseph Iskra

(57) ABSTRACT

An apparatus for the inductive heating of oil sand and heavy oil deposits by way of current-carrying conductors is provided. The conductors include individual conductor groups, wherein the conductor groups are designed in periodically repeating sections of defined length defining a resonance length, and wherein two or more of the conductor groups are capacitively coupled. In this way, each conductor can be insulated and can include a single wire.

18 Claims, 6 Drawing Sheets

(58) Field of Classification Search
USPC ..... 219/488, 544, 600, 603, 607, 611, 219/614–617, 629, 674.161; 166/245, 166/248, 50, 60, 302, 369, 272.1, 271.3; 392/301
See application file for complete search history.

(56) References Cited

U.S. PATENT DOCUMENTS

| | | | | |
|---|---|---|---|---|
| 5,130,193 | A * | 7/1992 | Ikeda | D07B 1/02 156/148 |
| 6,631,761 | B2 * | 10/2003 | Yuan | E21B 43/2401 166/248 |
| 8,766,146 | B2 * | 7/2014 | Diehl | E21B 36/04 219/600 |
| 2005/0199386 | A1 | 9/2005 | Kinzer | |

FOREIGN PATENT DOCUMENTS

| | | | |
|---|---|---|---|
| DE | 10 2007 040 605 | B3 | 10/2008 |
| DE | 10 2007 036 832 | A1 | 2/2009 |
| DE | 10 2007 040 606 | B3 | 2/2009 |
| EP | 0 771 135 | A1 | 5/1997 |
| RU | 2240659 | C2 | 11/2004 |
| RU | 223420 | C2 | 10/2005 |
| SU | 1350848 | A1 | 11/1987 |
| WO | WO 98/58156 | A1 | 12/1998 |
| WO | WO 01/43255 | A1 | 6/2001 |
| WO | WO 01/62379 | A1 | 8/2001 |

* cited by examiner

APPARATUS FOR THE INDUCTIVE HEATING OF OIL SAND AND HEAVY OIL DEPOSITS BY WAY OF CURRENT-CARRYING CONDUCTORS

This Application is a Continuation of U.S. patent application Ser. No. 12/920,869, filed Sep. 3, 2010 and claims the benefit thereof. U.S. patent application Ser. No. 12/920,869 is the US National Stage of International Application No. PCT/EP2009/052183, filed Feb. 25, 2009 and claims the benefit thereof. The International Application claims the benefits of German application No. 10 2008 012 855.4 DE filed Mar. 6, 2008 and German application No. 10 2008 062 326.1 filed Dec. 15, 2008. All of the applications are incorporated by reference herein in their entirety.

FIELD OF INVENTION

The invention relates to an apparatus for the inductive heating of oil sand and heavy oil deposits by way of current-carrying conductors.

BACKGROUND OF INVENTION

In order to convey heavy oils or bitumen from oil sand or oil shale deposits using pipe systems that are inserted through bore holes, the flowability of said heavy oils or bitumen must be considerably increased. This may be achieved by increasing the temperature of the deposit, referred to hereinafter as a reservoir. If, for this purpose, the known SAGD method is used exclusively, or inductive heating is used either exclusively or in addition to assist the known SAGD method, there is the problem that the inductive voltage drop along the long length of the inductor of, for example, 1000 m, may lead to very high voltages of up to several hundred kV, the reactive power of which cannot be controlled either in the insulation against the reservoir or the earth, or at the generator.

In order to assist reservoir heating by steam injection in accordance with the known SAGD method (steam assisted gravity drainage) or else as a complete replacement of this steam injection, different electromagnetically active inductor and electrode configurations may be used that are disclosed in detail in the applicant's unpublished applications DE 10 2007 036 832, DE 10 2007 008 292 and DE 10 2007 040 606.

In the general prior art of induction heating, the formation of highly inductive voltages can be prevented by a series connection consisting of inductor portions and integrated capacitors that are to be adapted to the working frequency as a series resonant circuit. The applicant's unpublished application DE 10 2007 040 605 discloses, in detail, a coaxial conductor apparatus comprising concentrated capacitances and implementing the principle of distributed capacitances based on the published German patent application DE 10 2004 009 896 A1. The former conductor apparatus has different characteristics, such as low flexibility, high production costs and expensive high-voltage ceramics. The latter conductor apparatus is not suitable for the intended purpose mentioned at the outset.

SUMMARY OF INVENTION

In contrast, the object of the present invention is to provide a conductor apparatus that can be used as an inductor apparatus for the purpose of heating oil sand.

The object is achieved in accordance with the invention by all the features of the claims. Developments are disclosed in the sub-claims.

In accordance with the invention it is proposed to capacitively couple two or more conductor groups in periodically repeated portions of defined length (resonance length). Each conductor is therefore insulated individually and consists of a single wire or a large number of wires that are, in turn, insulated. In particular, a 'multifilament conductor' structure is formed that has already been proposed in the field of electrical engineering for other purposes. A multiband and/or multifilm conductor structure may also optionally be produced for the same purpose.

In practical application, two conductor groups each comprising 1000-5000 filaments are typically required to carry out inductive heating for the intended purpose of heating oil sand at excitation frequencies of, for example, 10-50 kHz if effective resonance lengths ranging from 20-100 m are to be obtained. However, more than two conductor groups may also be provided.

In the assemblies according to the invention, the resonance frequency is inversely proportional to the distance between the interruptions of the conductor groups. A capacitively compensated multifilament conductor may be formed using specific HF litz wires. However, a capacitively compensated multifilament conductor may also be formed, alternatively, using solid wires.

In the invention a compensated multifilament conductor is advantageously formed of transposed or woven individual conductors in such a way that each individual conductor within the resonance length is found the same number of times on each radius. Similarly to conventional conductors of the Milliken type, a compensated multifilament conductor consisting of a plurality of conductor groups that are arranged about the common centre may be formed.

The individual compensated conductor sub-groups advantageously consist of stranded solid or HF litz wires. In this instance the cross-sections of the conductor sub-groups may deviate from the round or hexagonal shape and may, for example, be segment-shaped. The central conductor-free region within the cross-section of a compensated multifilament conductor of the Milliken type may be used to provide mechanical reinforcement in order to increase tensile strength. Permanently inserted or removable synthetic fiber cables or removable steel cables may be used for this purpose.

The central conductor-free region within the cross-section of a compensated multifilament conductor of the Milliken type may be used for cooling by way of a circulating liquid, in particular water or oil. Furthermore, temperature sensors may also be housed here and may be used to monitor and control the current feed and/or the liquid cooling.

In order to install the inductor, which consists of capacitively compensated multifilament conductors in the reservoir, it is recommended to preferably draw the inductor into a previously inserted plastics material pipe having a larger inner diameter. In this instance, for example, an oil may be introduced as a lubricant.

During operation, i.e. when current is fed to the conductor apparatus according to the invention, the space between the inductor and the plastics material pipe may be flooded with a liquid, in particular water of low electrical conductivity or, for example, transformer oil, which may also be used as the lubricant mentioned previously.

If active cooling of the inductor using a circulating coolant is desired, it is proposed, in accordance with the invention, to pump the coolant into the gap and into the central conductor-free region, what's more in opposite directions.

In particular, the developments and specific details of the invention mentioned above pose the following advantages:

- the conductor groups arranged inside one another and closely together are coupled in a highly capacitive manner. A series resonant circuit is thus formed, in which at the resonance frequency the phase shifts of current and voltage through the line inductances are compensated by capacitances between the conductor groups.
- the resonance frequency of the conductor is set by the distance between the interruptions. Furthermore, this length determines the inductive voltage drop and defines the requirements of the electric strength of the insulation or dielectric.
- the use of HF litz wires reduces or avoids the additional ohmic losses caused by the skin effect.

High capacitances per unit length are required if short resonance lengths are to be obtained in the multifilament conductor according to the invention. It is therefore necessary to split the entire conductor cross-section into a large number of individual conductors, for example up to several thousand individual conductors. The diameter of the individual conductor is then advantageously already small enough that there is no longer an increase in resistance caused by the skin effect.

In the invention, the weaving or transposing of the individual conductors within the resonance length avoids additional ohmic losses caused by the 'proximity effect'. It also reduces the requirements of the electric strength of the insulation of the dielectric through more homogeneous displacement current densities. The arrangement of a plurality of conductor sub-groups about the common centre makes it possible to use stranded wires (instead of woven or transposed wires without having to forego the reduction in additional ohmic losses caused by the proximity effect) and to simultaneously achieve simplified production.

When laying the inductor, as intended, in the reservoir of oil sand deposits, tensile stresses of several tens of tonnes are to be expected and could overburden the compensated conductor, weakened by interruptions, in such a way that, for example, the electric strength of the dielectric could be reduced. Mechanical reinforcement is thus desirable.

If the inductor is configured with a small conductor cross-section, in particular a cross-section made of copper, active cooling of the apparatus according to the invention may be necessary, open spaces or gaps advantageously being provided in the apparatus for this purpose. A plastics material pipe holds the bore hole open and protects the inductor during installation and operation. The tensile stress exerted on the inductor when it is drawn in is thus reduced by reducing friction. A liquid in the gap produces a good level of thermal contact relative to the plastics material pipe and relative to the reservoir, which is necessary for passive cooling of the inductor. At an ambient temperature of the reservoir of, for example, 200° C., ohmic losses in the inductor of up to approximately 20 W/m can be dissipated by heat conduction, without the temperature in the inductor exceeding 250° C., which is a critical value for Teflon insulation.

The flow of coolant in opposite directions inside and outside the conductor makes it possible to obtain a more uniform temperature along the inductor, which may be approximately 1000 m long, than would be possible with flows of coolant in the same direction.

BRIEF DESCRIPTION OF THE DRAWINGS

Further details and advantages of the invention will emerge from the following description of embodiments, given with reference to the claims and to the drawings, in which:

Like or functionally like components in the figures are denoted by like or corresponding reference numerals. The figures will be described together hereinafter in groups.

DETAILED DESCRIPTION OF INVENTION

Figure 1:
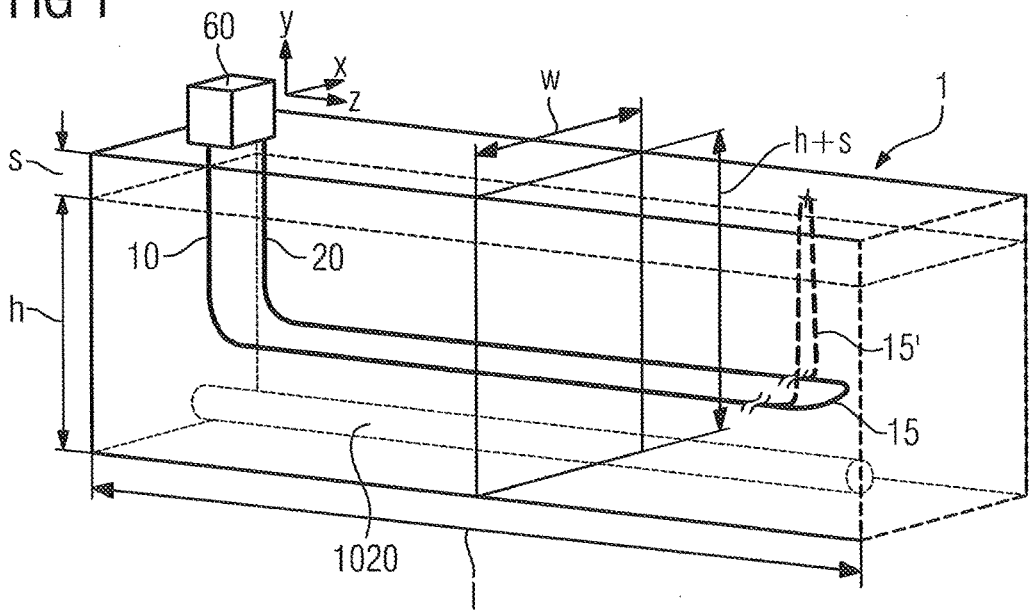
FIG. 1 is a perspective detail of an oil sand reservoir with an electric conductor loop extending horizontally in the reservoir.

FIG. 1 shows an oil sand deposit referred to as a reservoir, with reference always being made to a rectangular unit 1 of length 1, width w and height h when making specific observations. The length 1 may, for example, measure up to some 500 m, the width w may measure 60 to 100 m and the height h may measure approximately 20 to 100 m. It should be taken into consideration that, starting from the earth surface E, an 'overburden' of thickness s up to 500 m may be provided.

FIG. 1 shows an apparatus for the inductive heating of the reservoir detail 1. This may be formed by a long, i.e. measuring several hundred meters to 1.5 km, conductor loop 10 to 20 laid in the ground, the outgoing conductor 10 and the return conductor 20 being guided beside one another, i.e. at the same depth, and being interconnected at the end via a member 15 inside or outside the reservoir. At the start, the conductors 10 and 20 are guided down vertically or at a flat angle and may be supplied with electric power by a HF generator 60 that may be housed in an external housing.

In FIG. 1 the conductors 10 and 20 extend beside one another to the same depth. However, they may also be guided above one another. A feed pipe 1020 is illustrated beneath the conductor loop 10/20, i.e. on the base of the reservoir unit 1, via which feed pipe the liquefied bitumen or heavy oil can be transported.

Typical distances between the outgoing and return conductors 10, 20 are 5 to 60 m with an outer diameter of the conductors of 10 to 50 cm (0.1 to 0.5 m).

The electric double conductor line 10, 20 from FIG. 1 having the aforementioned typical dimensions comprises a series inductance per unit length of 1.0 to 2.7 μH/m. The shunt capacitance per unit length is only 10 to 100 pF/m with the dimensions given, in such a way that the capacitive cross-flows can initially be disregarded. In this instance wave effects should be avoided. The wave velocity is given by the capacitance and inductance per unit length of the conductor apparatus. The characteristic frequency of the apparatus is conditional on the loop length and the wave velocity along the apparatus of the double conductor line 10, 20. The loop length should therefore be kept short enough that no interfering wave effects are produced.

It can be seen that the simulated density distribution of power loss decreases radially in a plane perpendicular to the conductors, as is the case with current feed in antiphase to the upper and lower conductors.

For an inductively introduced heating power of 1 kW per meter of double conductor line, a current amplitude of approximately 350 A for low-resistance reservoirs having specific resistances of 30 Ω·m, and of approximately 950 A for high-resistive reservoirs having specific resistances of 500 Ω·m is required at 50 kHz. The current amplitude necessary for 1 kW/m decreases quadratically with the excitation frequency, i.e. at 100 kHz the current amplitudes fall to ¼ of the values above.

With a mean current amplitude of 500 A at 50 kHz and a typical inductance per unit length of 2 μH/m, the inductive voltage drop is approximately 300 V/m.

An electric and thermal configuration of a reactive power-compensated multifilament inductor will be described hereinafter in detail. The previous, unpublished German patent application DE 10 2007 040 605 already discloses the basic principle of compensation, over portions, of a coaxial line with distributed capacitances. The following is based on the description of the previous application relating to this aspect:

A specific example of a configuration of a capacitively compensated multifilament conductor is presented as follows: two conductor groups have, together, for example a copper cross-section of 1200 $mm^2$. This cross-section is divided into 2790 individual solid wires each having a diameter of 0.74 mm. Each of the wires has insulation made of Teflon with a wall thickness of slightly more than 0.25 mm and is brought to the doubled resonance length of 2×20.9 m=41.8. The wires are arranged in the longitudinal direction, offset relative to the resonance length in accordance with FIG. 4, described in greater detail below.

Figure 5:
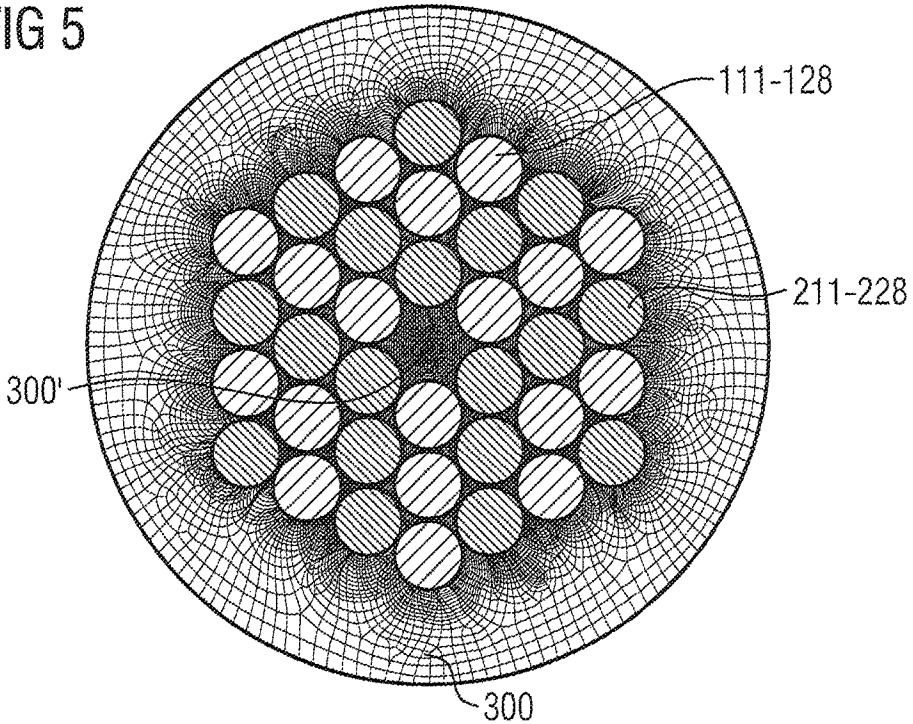
FIG. 5 is a cross-sectional view of a multifilament conductor.

The cross-section of the conductor apparatus resembles a hexagonal grid and is reproduced in FIG. 5. In this instance the cross-sectional plane is pressed in such a way that the wires are brought to a mutual distance of 0.5 mm. The redundant insulation fills the spaces in the hexagonal grid. The two conductor groups have a capacitance per unit length of 115.4 nF/m with an alternate arrangement of the wires on the rings in accordance with FIG. 5. With the resonance length of 20.9 m, the conductor is capacitively compensated at 20 kHz. The ohmic resistance is thus 30 μΩ/m, also at 20 kHz. With an alternating current amplitude of 825 A (peak), an inductive heating power of 3 kW/m (rms) can be inserted in a reservoir having a specific resistance of 555 Ωm if the outgoing and return conductors have a distance of 106 m and this configuration is periodically continued. In this instance the ohmic losses in the conductor averaged over a resonance length add up to 15.1 W/m (rms). Depending on the underlying thermal model of the reservoir zrs, T=200° C. constant at 0.5 m or 2.5 m distance from the conductor, these lead to a heating of the conductor of 230-250° C., with no additional liquid cooling being necessary. In this instance the insulation must withstand a voltage of 3.6 kV. For Teflon, electric strengths of 20-36 kV/mm are given, i.e. approximately one third of the electric strength is required with an insulation thickness of 0.5 mm.

Figure 2:
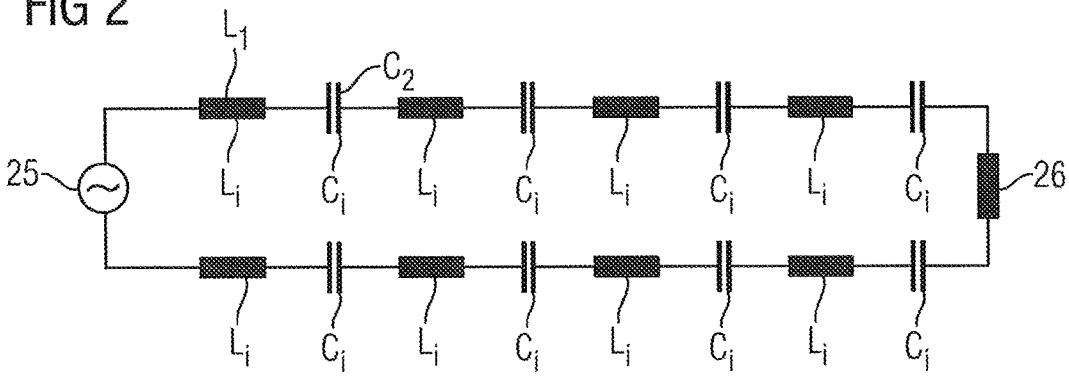
FIG. 2 is a circuit diagram of a series resonant circuit with concentrated capacitances for compensation of the line inductances.

In accordance with the schematic view shown in FIG. 2 it is provided for the line inductance L to be compensated over portions by discrete or continuous series capacitances C. This is shown in a simplified manner in FIG. 2. An equivalent schematic view of a conductor circuit operated by an alternating current source 25 and having a complex resistor 26 is shown, in which in each case inductors $L_i$ and capacitors $C_i$ are provided over portions. The line is thus compensated over portions.

The latter type of compensation is known from the prior art in systems for inductive energy transfer to systems moved in a translatory manner. In the present context specific advantages are therefore posed.

A characteristic of compensation integrated into the line is that the frequency of the HF line generator must be matched to the resonance frequency of the current loop. This means that the double conductor line 10, 20 of FIG. 1 can expediently only be operated at this frequency for inductive heating, i.e. with high current amplitudes.

The key advantage of the latter approach lies in that an addition of the inductive voltages along the line is prevented. If, in the example above, i.e. 500 A, 2 μH/m, 50 kHz and 300 V/m, a capacitor $C_i$ is, for example, inserted in each case every 10 m in the outgoing and return conductors of 1 μF capacitance, this apparatus may be operated resonantly at 50 kHz. The inductive and corresponding capacitive accumulated voltages occurring are therefore limited to 3 kV.

If the distance between adjacent capacitors $C_i$ is reduced, the capacitances must increase in a manner that is inversely proportional to the distance (with a requirement of the electric strength of the capacitors that is proportional to the distance) in order to obtain the same resonance frequency.

Figure 3:
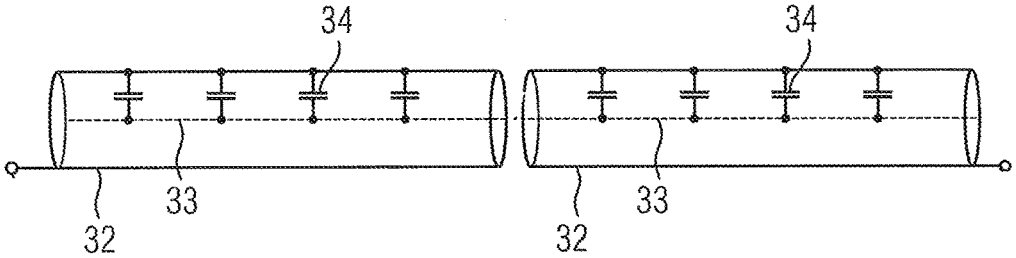
FIG. 3 is a diagram of a capacitively compensated coaxial line with distributed capacitances.

FIG. 3 shows an advantageous embodiment of capacitors integrated into the line having a respective capacitance C. The capacitance is formed by cylindrical capacitors $C_i$ between a tubular outer electrode 32 of a first portion and a tubular inner electrode 34 of a second portion, between which a dielectric 33 is arranged. Accordingly, the adjacent capacitor is formed between subsequent portions.

In addition to high electric strength, high thermal stability is also required for the dielectric of the capacitor C since the conductor is arranged in an inductively heated reservoir 100 that may reach a temperature of, for example, 250° C. and the resistive losses in the conductors 10, 20 may lead to further heating of the electrodes. The requirements of the dielectric 33 are satisfied by a large number of capacitor ceramics.

In practice, for example, the groups of aluminum silicates, i.e. porcelains, exhibit thermal stabilities of several hundred degrees centigrade and electric dielectric strengths of >20 kV/mm with permittivity values of 6. Upper cylindrical capacitors can therefore be formed with the necessary capacitance and may, for example, be between 1 and 2 m long.

If the length should be shorter, a plurality of coaxial electrodes can be nested inside one another in accordance with the principle illustrated with reference to FIGS. 2 to 4. Other conventional capacitor designs may also be integrated in the line, provided they exhibit the necessary electric strength and thermal stability. The radial formation of the conductor apparatus that is illustrated with reference to the cross-sectional views is used for this purpose.

Figure 4:
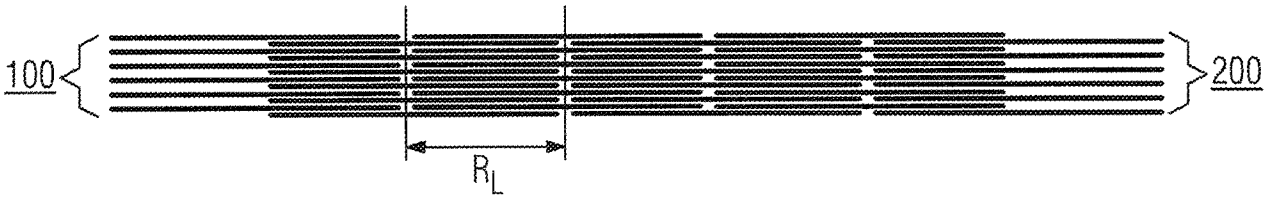
FIG. 4 is a diagram of the capacitively coupled filament groups in the longitudinal direction.

FIG. 4 shows the main schematic view of two capacitively coupled filament groups 100 and 200 in the longitudinal direction. It can be seen that individual wire portions of predetermined length are periodically repeated and that a second structure 200 with individual wire portions is arranged in a first structure 100, each being of the same length and the first group of wire portions overlapping with the second group of wire portions over a predetermined distance. A resonance length $R_L$ is thus defined, which signifies the capacitive coupling of the filament groups in the longitudinal direction.

In FIG. 5 the entire inductor arrangement is already surrounded by insulation 300. Insulation against the surrounding earth is necessary in order to prevent resistive currents through the earth between the adjacent portions, in particular in the region of the capacitors. The insulation also prevents the resistive current flow between the outgoing and return conductors. However, the requirements of the insulation with regard to electric strength are reduced in comparison with the uncompensated line from >100 kV to slightly more than 3 kV in the example above and are therefore satisfied by a large number of insulating materials. The insulation must permanently withstand higher temperatures, similarly to the dielectric of the capacitors, ceramic insulating materials again being suitable. In this instance the thickness of the insulation layer must not be too low since otherwise capacitive leakage currents could flow into the surrounding earth. Greater insulating material thicknesses, for example 2 mm, are sufficient in the above embodiment.

Sectional views of a corresponding apparatus with 36 filaments that in turn consist of two filament groups are shown in FIGS. 5, 9, 10 and 12. In this instance FIG. 5 in particular illustrates the structure and combination of the nested apparatus formed of 36 filaments. More specifically, in this instance the filament conductors of the first group are denoted by reference numerals 111-128 and the filament conductors of the second group are denoted by reference numerals 211-228. In the structure in accordance with a hexagonal-type arrangement a central region 300' in the centre of the conductor is free.

Figure 6:
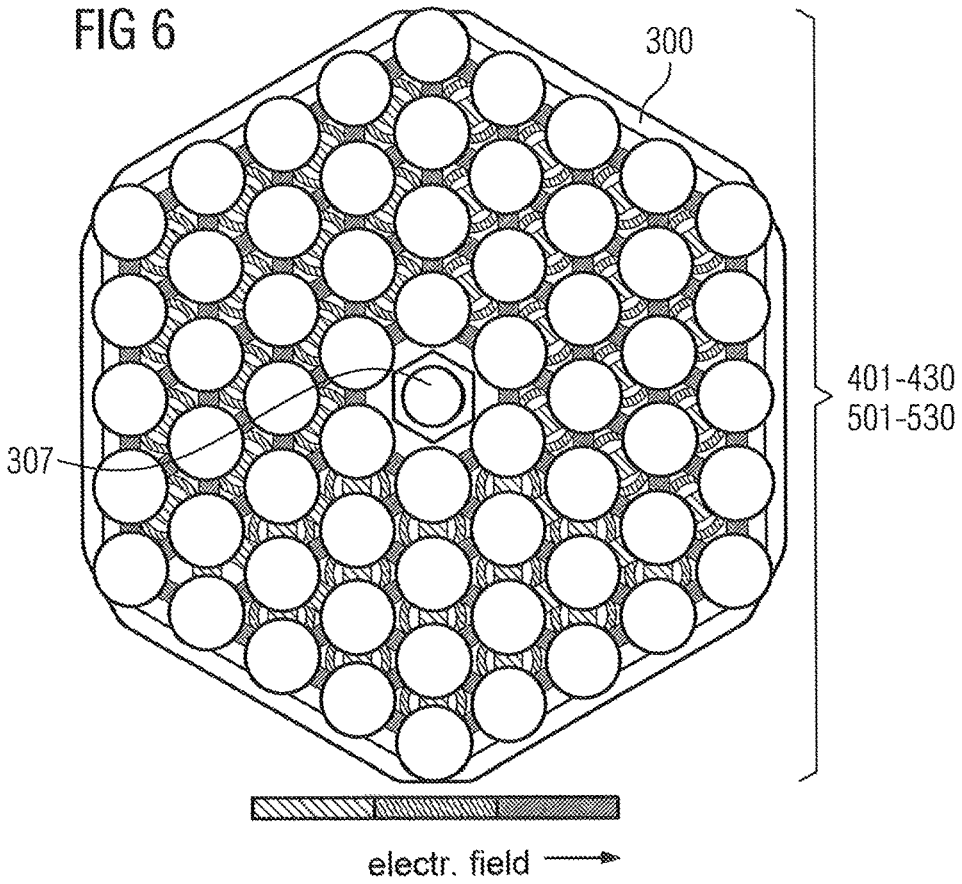
FIG. 6 is a cross-sectional view of the distribution of the electric field of a 2-group, 60-filament conductor.

Overall, predetermined insulations are thus produced in accordance with the intensity structure. FIG. 6 shows a cross-section of a 2-group, 60-filament apparatus that in turn has a hexagonal structure. In this instance the conductors 401 to 430 (hatched to the left) belong to the first group of filament conductors and the conductors 501 to 530 (hatched to the right) belong to the second group of filament conductors. The conductor groups are embedded in an insulating medium. The specific structure of the conductor groups produces individual conductors in each case that are connected in groups via a high intensity electric field and are each connected to other conductors via a low field, which can be confirmed by model calculations.

With the hexagonal structure according to FIGS. 5 and 6, central regions 300' and 307 respectively are field-free. The regions 300' of FIG. 5 and the region 307 of FIG. 6 may be used to insert coolants or else to insert mechanical reinforcements with the aim of increasing tensile strength. For example, permanently inserted or removable artificial fiber cables or else removable steel cables can be used for this purpose. This matter is discussed further in greater detail hereinafter.

Figure 7:
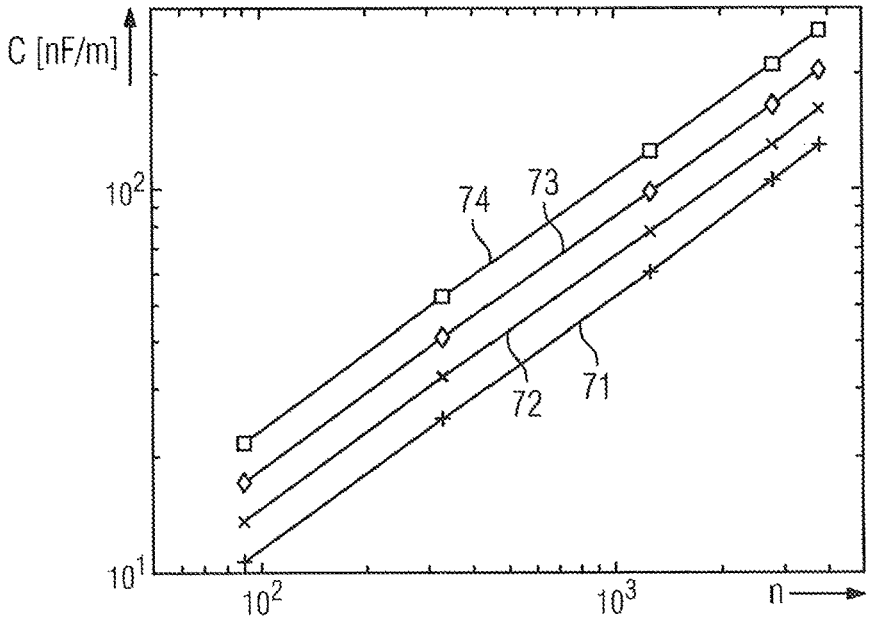
FIG. 7 is a graph showing the capacitance per unit length of two conductor groups as a function of the number of conductors.

The graph according to FIG. 7 shows, in each case on a logarithmic scale, the number n of individual wires on the abscissa and the series capacitance in μF/m on the ordinate. Graphs 71 to 74 are shown for different conductor cross-sections: 71 for a cross-section of 600 $mm^2$, 72 for a cross-section of 1200 $mm^2$, 73 for a cross-section of 2400 $mm^2$ and 74 for a cross-section of 4800 $mm^2$.

The individual graphs 71 to 72 extend parallel with the same monotonic increase: as expected the litz wire capacitance increases exponentially with the number of wires, but linearly with the cross-section.

It can be derived from FIG. 7 that the capacitive compensation can be adjusted, on the one hand, as a function of the number of conductors and, on the other hand, as a function of the total cross-section. In this instance a geometry of the conductors according to FIGS. 4 and 5 was based on identical Teflon insulation in each case. With a predetermined cross-sectional surface, the necessary number of stranded conductors can thus be determined.

Figure 8:
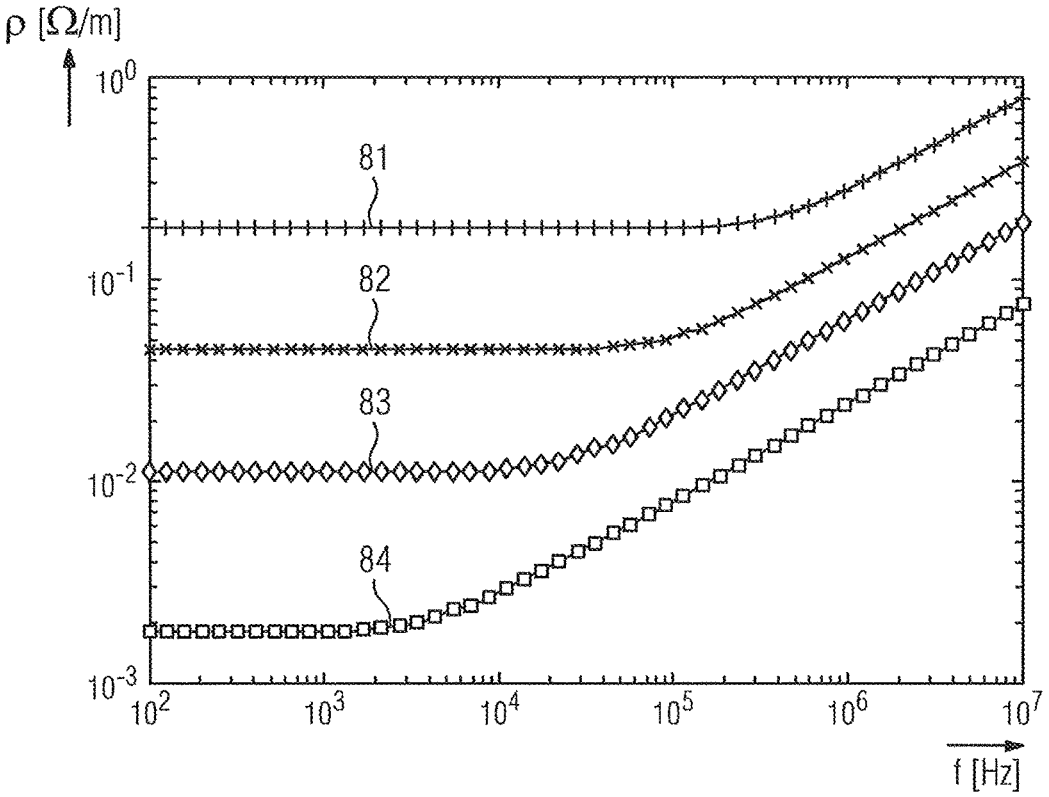
FIG. 8 is a graph showing the dependency on frequency of the ohmic resistance for different wire diameters.

The graph illustrated in FIG. 8 shows the dependency on frequency of the ohmic resistance for different wire diameters. The frequency is plotted on the abscissa in Hz and the resistance per unit of length R is plotted on the ordinate in Ω/m, the logarithmic scale being selected in turn for both coordinates. Graphs 81 to 84 are shown as parameters for different wire diameters: 81 for a diameter of 0.5 mm, 82 for a diameter of 1 mm, 83 for a diameter of 2 mm and 84 for a diameter of 5 mm.

Graphs 81 to 84 extend, in the starting region, parallel to the abscissa and then rise monotonically with substantially the same increase: as expected the resistance increases exponentially, on the one hand, with frequency and, on the other hand, with wire diameter. In this instance a temperature of 260° C. is assumed during current feed.

In particular, the influence of the skin effect, at the given temperature, can be seen from the curve in graphs 81 to 84 in FIG. 8. Graphs 81 to 84 show that the ohmic resistance is initially substantially constant in the range up to different limiting frequencies between $10^3$ and $10^5$ Hz, the resistance being inversely proportional to the wire diameter, and also that resistance increases with frequency.

Figure 9:
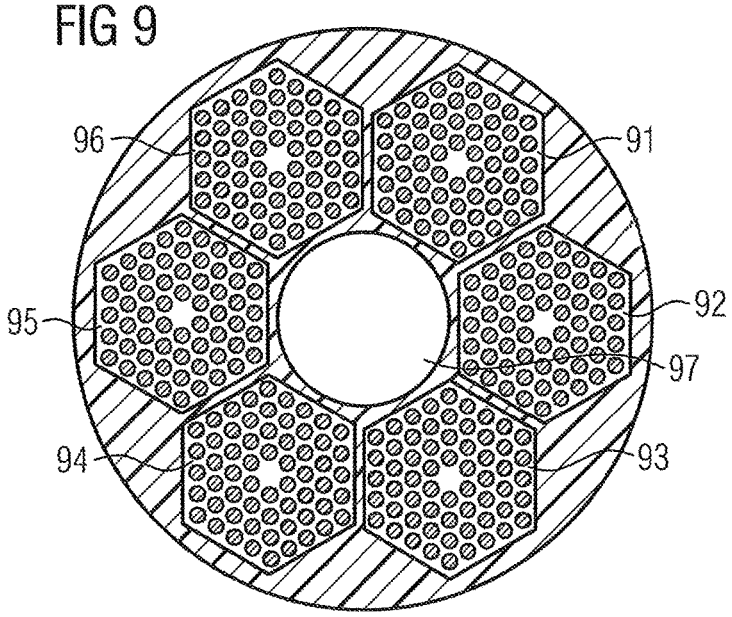
FIG. 9 is a cross-sectional view of a stranded, compensated multifilament conductor of the Milliken type.
Figure 10:
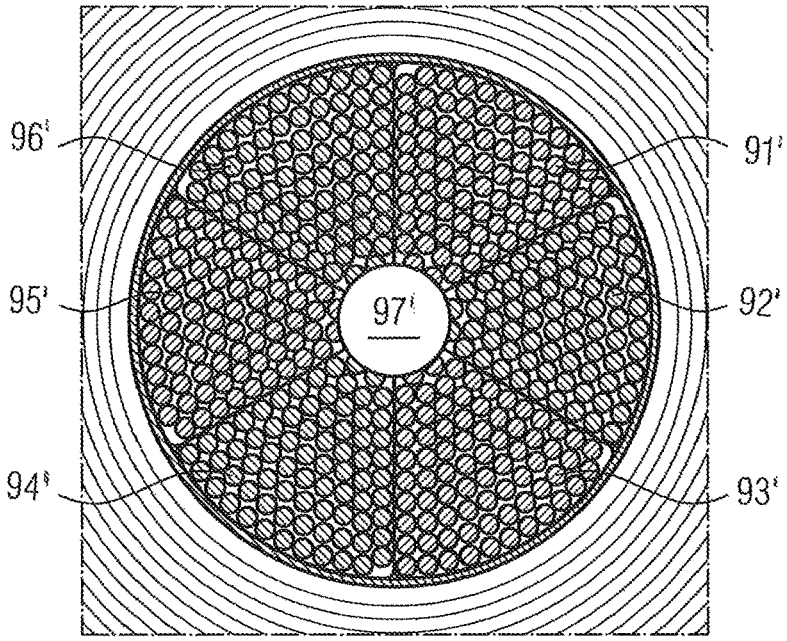
FIG. 10 shows an alternative to FIG. 9.

Six hexagonal conductor bundles 91 to 96 are arranged about a central void 97 in FIG. 9. In contrast, six approximately cake slice-shaped conductor bundles 91' to 96' are arranged as segments about a central void 97' in FIG. 10. The empty spaces 97 and 97' contain possible means for receiving cooling devices or mechanical reinforcement devices. Corresponding means are not shown in detail in FIGS. 9 and 10.

Figure 11:
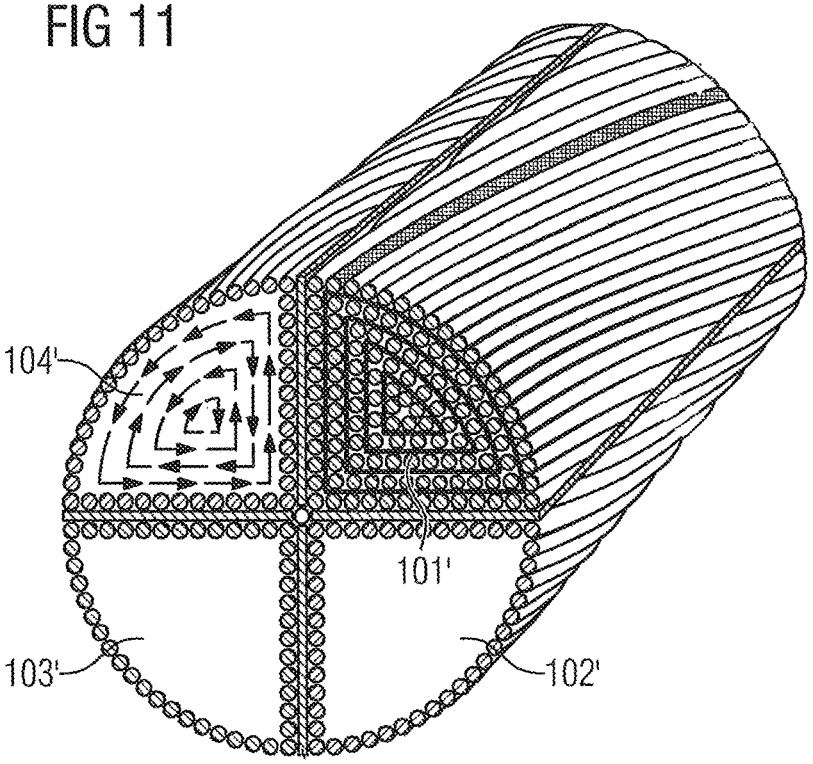
FIG. 11 is a perspective view of a four-quadrant conductor.

FIG. 11 is a perspective view of a four-quadrant conductor designated as 101'-104'. FIG. 11 shows that it is advantageous, with a principle arrangement in accordance with FIG. 10 with segment-shaped members formed of individual conductors, for the individual conductors to be twisted in the longitudinal direction of the entire cable. Lines from, for example, C to D are therefore produced on the periphery of the conductor and these indicate the azimuthal twisting of the individual conductors. In this instance there is a field distribution in the left-hand quadrant in the interface that corresponds to the arrows shown.

Figure 12:
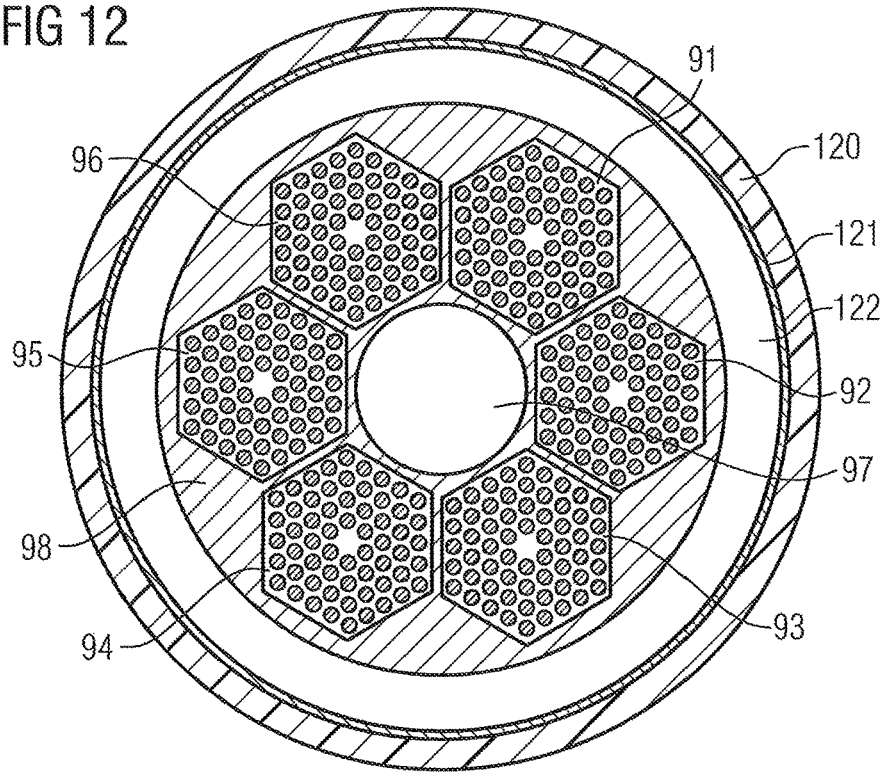
FIG. 12 is a cross-sectional view of a stranded, compensated multifilament conductor of the Milliken type in a guide pipe.

FIG. 12 shows a plastics material pipe 120, in which an apparatus comprising stranded conductors is inserted. The pipe 120 may, for example, consist of plastics material, an annular gap 121 being formed in the pipe 120, in which gap the insulator having the hexagonal conductor structures 122 is inserted. In this instance there is basically a central conductor-free region 97, in which aids required for the intended use of the described conductors may be inserted. In particular, an apparatus of this type with the conductor-free centre 97 makes it possible to use stranded wires instead of woven or transposed wires without having to forego the reduction in additional ohmic losses caused by the proximity effect. Comparatively simple production is thus made possible.

The relevant boundary conditions should be observed for the intended use of the conductor assemblies described in detail, in particular with reference to FIGS. 4, 5 and 9 to 12, for heating oil sand reservoirs and extending over several hundred meters. In particular, considerable tensile stresses that may lie within a range of several tens of tonnes should be expected when laying the inductor. The compensated conductor, weakened by interruptions according to FIG. 4, may therefore be overburdened to such an extent that the electric strength of the dielectric is reduced. Mechanical reinforcements are provided for this purpose, in particular in the form of steel cables. Furthermore, active cooling may be required.

In the apparatus according to FIG. 12, the outer plastics material pipe 120 is used, in particular, to keep the bore hole open as well as to protect the inductor during installation and operation of the system comprising the apparatus for the inductive heating of the oil sand deposits. The tensile stress on the inductor when it is drawn in is thus reduced as a result of a decrease in friction.

The liquid for cooling an annular gap 120 may be arranged inside the plastics material pipe 120, particularly in the apparatus according to FIG. 12. In this case the liquid produces a good level of thermal contact relative to the plastics material pipe 120 and, moreover, relative to the reservoir, at least passive cooling of the inductor being necessary in turn. For example, with an ambient temperature of the reservoir of, for example, 200° C., the ohmic losses in the indictor of approximately 20 W/m are dissipated by the heat conduction without the temperature in the inductor exceeding 250° C., which is the critical value for Teflon insulation.

The apparatus according to FIG. 12 also offers the possibility of cooling in opposite directions. In this instance the central void 97 is used for one direction of the flowing liquid and the annular space 121 inside the plastics material pipe 120 is used for the other direction of the flowing liquid.

Figure 13:
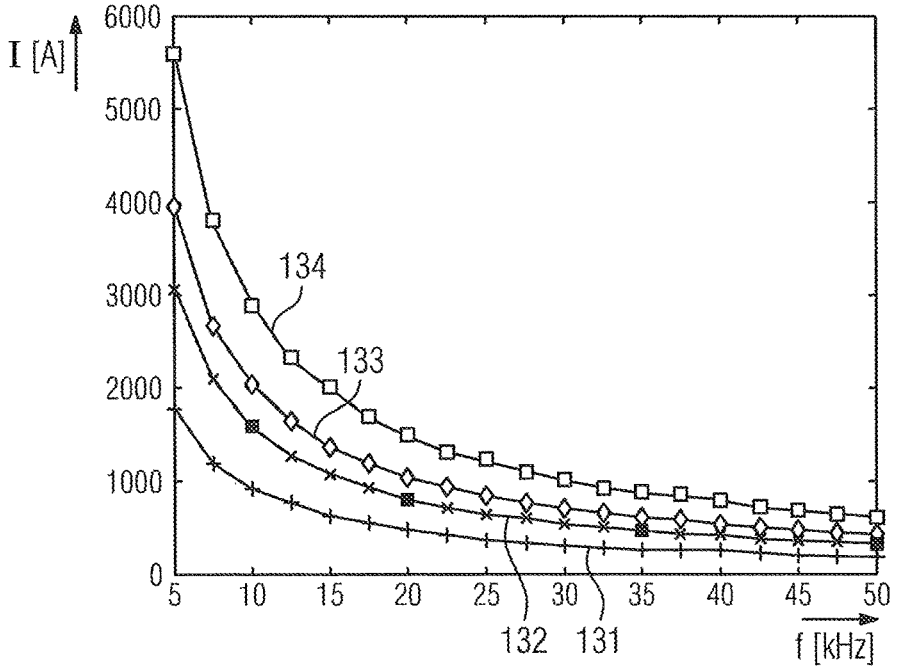
FIG. 13 is a graph showing the dependency of the current feed to the inductor on frequency for different heating powers.

In FIG. 13, in each case represented by a line, the frequency in kHz is plotted on the abscissa and the inductor flow in amps is plotted on the ordinate. The dependency of the inductor flow on frequency is illustrated, different heating powers being given as parameters: 1 kW/m for graph 131, 3 kW/m for graph 132, 5 kW/m for graph 133 and 10 kW/m for graph 134.

The individual graphs 131 to 134 each have an approximately hyperbolic curve. This means that the current feed to the inductor becomes more heavily dependent on frequency as the heating power increases, provided there are constant power losses in the reservoir. In this respect the currents and/or frequencies required for defined heating powers can be read with reference to graphs 131 to 134.

The assemblies described in detail with reference to the figures and comprising the capacitively compensated multifilament conductors make it possible to achieve effective inductive heating of oil sands or other heavy oil deposits. Calculations and tests have found that effective heating of the reservoir is achieved, whereby the viscosity of the bitumen or heavy oil embedded in the sand is reduced and therefore sufficient flowability of the previously highly viscous raw material is obtained.

The invention claimed is:

1. An apparatus for the inductive heating of oil sand and heavy oil deposits, comprising:

a plurality of current-carrying conductors which are grouped into individual conductor groups, each conductor group having multiple current-carrying conductors, wherein the individual conductor groups are formed in periodically repeated portions of defined length that define a resonance length, wherein two or more of the individual conductor groups are capacitively coupled along a longitudinal direction based on the resonance length, and form a multifilament or multiband or multifilm conductor structure, and a tensile strength enhancing mechanical reinforcement device disposed in a central conductor-free region of the apparatus.

2. The apparatus as claimed in claim 1, wherein each of the conductors is individually insulated and includes a single wire.

3. The apparatus as claimed in claim 1, wherein each of the conductors includes a plurality of insulated wires that form a 'HF litz wire'.

4. The apparatus as claimed in claim 3, wherein two of said conductor groups, each comprising 1000 to 5000 filaments are provided which include resonance lengths ranging from approximately 20 m to approximately 100 m.

5. The apparatus as claimed in claim 3, wherein a capacitively compensated multifilament conductor of said conductor groups is formed of transposed or woven individual conductors is formed in such a way that each individual conductor within the resonance length is found the same number of times on each radius of the apparatus.

6. The apparatus as claimed in claim 3, wherein a compensated multifilament conductor of said conductor groups is formed of a plurality of conductor sub-groups that are arranged about a common center.

7. The apparatus as claimed in claim 6, wherein the individual compensated conductor sub-groups include stranded solid or HF litz wires.

8. The apparatus as claimed in claim 6, wherein a plurality of cross-sections of the plurality of conductor sub-groups are round or hexagonal.

9. The apparatus as claimed in claim 7, wherein the plurality of conductor sub-groups are segment-shaped.

10. The apparatus as claimed in claim 1, wherein plastics material fiber cables or glass fiber cables or steel cables are used to provide the mechanical reinforcement device.

11. The apparatus as claimed in claim 1, wherein the central conductor-free region within the cross-section of a compensated multifilament conductor of said conductor groups includes a means for cooling.

12. The apparatus as claimed in claim 11, wherein a flowing liquid is provided or may be introduced as the means for cooling.

13. The apparatus as claimed in claim 12, wherein temperature sensors are arranged in a central region and may be used to monitor and/control a current feed and/a liquid cooler, wherein the temperature sensors comprise glass fiber sensors or Bragg fibers.

14. The apparatus as claimed in claim 1, wherein a defined inductance and a defined capacitance per unit length of each of the plurality of current carrying conductors is provided in such a way that the apparatus may be operated in a serially compensated manner at a previously determined frequency.

15. The apparatus as claimed in claim 14, wherein the plurality of current carrying conductors are inserted in a plastics material pipe.

16. The apparatus as claimed in claim 15, wherein a lubricant is provided between the plastics material pipe and the plurality of current carrying conductors.

17. The apparatus as claimed in claim 15, wherein a liquid of low electric conductivity or a lubricating liquid or insulating liquid is provided during operation between the plurality of current carrying conductors and the plastics material pipe.

18. The apparatus as claimed in claim 16, wherein a coolant is pumped into a gap between the plastics material pipe and the conductor groups and into the central conductor-free region in opposite directions.

* * * * *